United States Patent [19]

Broodman

[11] Patent Number: 4,817,672

[45] Date of Patent: Apr. 4, 1989

[54] COMPOSITE TUBE FOR HEATING GASES

[75] Inventor: Johannes J. Broodman, Breskens, Netherlands

[73] Assignee: Jogema Holding B.V., Middelburg, Netherlands

[21] Appl. No.: 827,554

[22] Filed: Feb. 10, 1986

[30] Foreign Application Priority Data

Feb. 12, 1985 [NL] Netherlands ..... 8500393

[51] Int. Cl.[4] ..... F16L 11/00

[52] U.S. Cl. ..... 138/113; 12.2/DIG. 13; 136/114; 165/154

[58] Field of Search ..... 122/10, 510, 511, DIG. 13; 165/154; 138/113, 114, 140; 196/110; 208/132

[56] References Cited

U.S. PATENT DOCUMENTS

| | | | |
|---|---|---|---|
| 1,887,155 | 11/1932 | Harnsberger | 196/110 |
| 3,113,595 | 12/1963 | Cotman, Jr. | 138/113 |
| 3,126,918 | 3/1964 | Gaton | 138/113 |
| 3,830,173 | 8/1974 | Hubble et al. | 138/114 |
| 4,014,369 | 3/1977 | Kobres, Jr. | 138/114 X |
| 4,096,616 | 6/1978 | Coffinberry | 165/154 X |
| 4,463,061 | 7/1984 | Otoguro et al. | 122/511 X |
| 4,615,359 | 10/1986 | Affai et al. | 138/114 X |

FOREIGN PATENT DOCUMENTS

| | | | |
|---|---|---|---|
| 74435 | 3/1983 | European Pat. Off. . | |
| 2100528 | 7/1971 | Fed. Rep. of Germany . | |
| 2915838 | 10/1980 | Fed. Rep. of Germany | 113/114 |
| 2923596 | 12/1980 | Fed. Rep. of Germany . | |
| 962338 | 1/1953 | France . | |
| 684602 | 12/1952 | United Kingdom . | |
| 701215 | 12/1953 | United Kingdom . | |
| 1302463 | 1/1973 | United Kingdom . | |
| 2021632 | 12/1979 | United Kingdom . | |
| 2039020 | 7/1980 | United Kingdom . | |

*Primary Examiner*—Steven E. Warner

*Attorney, Agent, or Firm*—Dennison, Meserole, Pollack & Scheiner

[57] ABSTRACT

Composite tube for heating gases to very high temperatures, in particular for generating steam, comprising at least one internal combustion or heating tube (6), an external reinforcement (3) which surrounds the internal tube (6) and spacer means (2,5) for separating the internal tube (6) from the external reinforcement, in which the materials of the internal tube (6) are resistant to the milieus of the heating gases coming into contact with this tube. A jacket tube (1) may be placed between the internal combustion or heating tube (6) and the external reinforcement (3). In the composite tube of this invention the heating tube wall thickness can be reduced and higher temperatures and heat flows can be achieved than hitherto possible.

20 Claims, 6 Drawing Sheets

COMPOSITE TUBE FOR HEATING GASES

The invention relates to a composite tube for heating gases to very high temperatures, wherein very high heat flows through the wall between the heating gases and the gases which are to be heated are possible. This apparatus is in particular intended for generating steam at very high temperature, for example for the purpose of pyrolysis and for heating inert gases to a high temperature, for example closed cycle gas turbine systems, or as a source of heat for reactors or heat exchangers.

The heating of steam to very high temperatures can for example be very advantageously applied to the production of ethylene from naphtha or heavy oil products.

Ethylene is for example at present produced in tube furnaces, known as cracking furnaces. Saturated hydrocarbons, mixed for example with steam, are passed through tubes in these furnaces while external heat is supplied by gas- or oil-fired burners. FIG. 1 shows a conventional furnace of this type, in which a large number of banks of tubes in a furnace are heated by burners.

A great disadvantage of these conventional installations, in which a multiplicity of banks of tubes are disposed in a space heated by a large number of burners, is that all the reactor tubes are exposed over their entire length to the same temperature. This fact along limits the maximum flow of heat, because the most extreme conditions occurring very locally in a single cracking tube are the determining factor.

As a result of the low mean heat flow through the tube walls, the length of the cracking tubes in conventional furnaces is necessarily of the order of 50 to 100 meters. Owing to this relatively great length, the residence times are too long and the pressure drops too great, and therefore are not optimum, for many processes.

In most cases, such as the cracking of hydrocarbons to form, for example, ethylene, propylene, butylene, etc., better conversion yields are obtained if the reaction temperatures are raised and shorter residence times are used.

Too great a loss of heat has the direct consequence of design limitations in the case of high temperature levels, this being due to the poor strength properties (creep) of metals under such conditions, while these limitations can be compensated only by a lower temperature of the material during operation.

In the case of the production of ethylene a highly endothermic cracking reaction is involved.

In conventional installations temperature levels of the tube material up to about 900° C. are applied with a limited pressure, for example 3 to 10 atmospheres, while in some more advanced installations temperatures of 1000° to 1075° C. are applied.

The cracked product must moreover be cooled quickly in order to conserve the maximum conversion achieved.

It is usually of great advantage for cracking processes of this kind to proceed quickly, which means above all that the heat transition through the cracking tubes must be very great, while nevertheless the temperature difference over the wall must be very low in order to achieve the highest possible temperature level in the medium which is to be heated.

It is known that for cracking processes it is advantageous for as much heat as possible to be supplied at the commencement of the reaction, for example with superheated steam or another gas, while the endothermic reaction is continued in the cracking tube by the supply of additional heat needed for the reaction.

There is thus a need for tubes for heating, for example, steam as a gas to temperatures of 1300° to 1400° C.

Although gas temperatures of about 1075° C. are already reached inside tubes in the heating of, for example, steam or cracking products, the heat flow through the wall has hitherto been very limited because temperatures much above 1100° C. are not permissible even for the best high-alloy materials. The internal pressures in the tubes for this kind of application are very limited, because the structure must be at least sufficiently strong to be able to take the load resulting from internal pressure and dead weight.

Although it is conceivable that in the future it will be possible to build larger installations with ceramic materials, so that it will be possible to reach much higher temperatures than can be done with metals, these materials form a very considerable heat transition barrier, so that the combination of the highest possible temperature, on the one hand, and very low resistance to heat, on the other hand, in order to achieve a very large heat flow such as is now required, will even then not be possible.

A composite tube has been developed with which it is expected to be possible to reach temperatures up to 1250° C. for certain applications. This composite tube is reinforced by an internal network of, for example, molybdenum, which determines the strength of the composite tube (see FIG. 2). However, the wall thickness due to the nature of the structure limits the permissible heat flow through the wall.

The invention now proposes to provide a composite tube for heating steam or gas, or particularly inert gas, with which the disadvantages mentioned above are avoided, while far higher temperatures and heat flows can be achieved than were hitherto possible.

The composite tube according to the invention is characterized by at least one internal heating or combustion tube, an external reinforcement surrounding the internal heating or combustion tube, and spacing means for separating the internal tube from the external reinforcement, the materials for the internal combustion tube being resistant to the milieus of the gases which come into contact with these tubes.

A tube of this kind will as a rule be used in the heating to a high temperature of inert gases which are situated between the internal tube and the external reinforcement and which are heated by th burning or heated gas in the inner tube.

In a modified embodiment of the invention, which is applied for example to the heating of steam in a cracking installation, a jacket tube is provided between the internal combustion or heating tube and the external reinforcement in order to shield the reinforcement against the gas, such as steam, which is situated between the inner tube and the jacket tube. This jacket tube is supported both against the inner tube and against the external reinforcement with the aid of support and/or spacer means.

An important difference from most known arrangements is that the heat is supplied solely from inside, and that the reinforcement disposed on the outside is subjected to no or only slight heat load and is not acted on by harmful gases.

The external reinforcement is preferably composed of special heat-resistant materials, such as molybdenum, tungsten, tantalum or niobium, or of alloys thereof, while ceramic material can be used for the intermediate jacket tube.

The combustion tube will preferably be made of a material, such as nickel or nickel alloys, which is particularly resistant to high temperatures and to a corrosive environment of combustion gases. However, ceramic material may also be used for this purpose.

The support means and the spacer means between the different tubes are also preferably made of heat-resistant material, particularly ceramic material.

With the composite tube according to the invention it is possible to reach temperatures of 1300° to 1400° C., whereby in the production of ethylene the yield will be substantially increased, while considerable improvements of efficiency in respect of fuel consumption can be achieved. In applications to cracking plants, for example, the tubes according to the invention may now have diameters larger than those of cracking tubes at present customarily used. Less heated surface is thus required.

The combustion gases needed for the heating are passed through the internal combustion tube, while the gas or cracking product which is to be heated is passed through the space between the combustion tube and the jacket tube surrounding the latter or the outer reinforcement, depending on the gas to be heated.

The reinforcement may consist of a tube, but may also be composed of braided or coiled wires, which can be supported by another tube or casing. Thermal insulation may be applied around this reinforcement as a jacket, so that losses to the outside are still further reduced.

Another advantage of the composite tube according to the invention is that the external reinforcement lying outside the gas which is to be heated or outside the reaction space is at the lowest temperature occurring in the system, in contrast to conventional arrangements. Owing to the fact that this member, which gives the structure its strength, has the lowest temperature, far higher temperatures of the medium which is to be heated can be achieved, even with conventional materials, than in the customary manner. Through the use of materials such as molybdenum, tungsten and tantalum, the properties of the composite tube can be further substantially improved.

In contrast to the solutions previously mentioned, in teh construction according to the invention it is precisely advantageous for the heat transition through the outer sheath to be low.

In the construction according to the invention a burner tube, that is to say an internal tube, can be used which has a very slight wall thickness, for example from 0.5 to 1 mm of nickel, thus permitting the abovementioned temperatures of 1300° to 1400° C. with a very high heat flow.

The external reinforcement and the intermediate jacket tube must precisely prevent the passage of any heat in this application, so that in this respect no special requirements, other than those relating to strength and milieu, need be imposed on them.

The invention will now be explained with the aid of the drawings, in which some examples of its embodiment are ilustrated.

Figure 3:
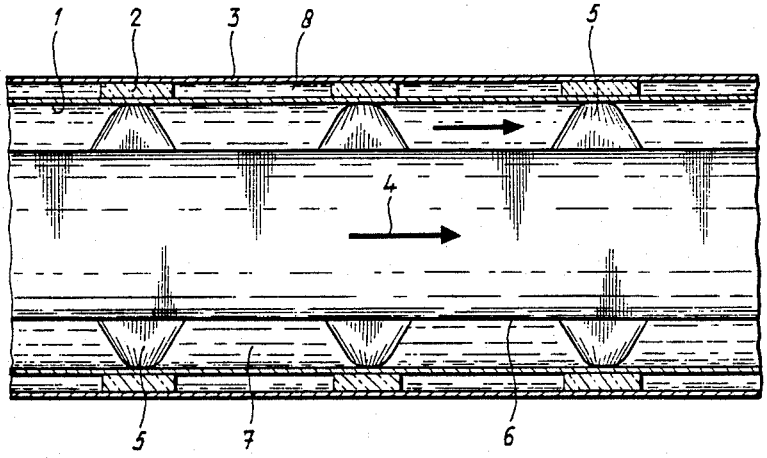
FIG. 3 is an axial section of a first form of construction of the composite tube according to the invention.
Figure 4:
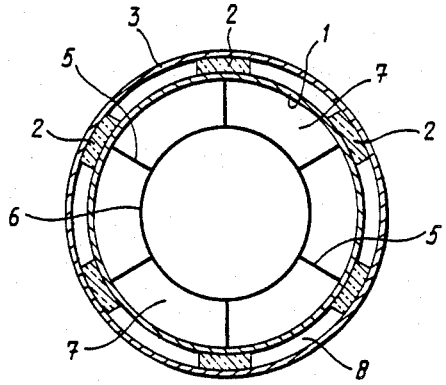
FIG. 4 is a radial cross-section of the composite tube shown in FIG. 3.

FIGS. 3 and 4 show one of the possible forms of construction of a composite tube according to the invention. An interposed jacket tube 1, made of corrosion-resistant material and provided with ceramic spacer or support means 2, is surrounded by an external reinforcement 3 made of molybdenum, tungsten or tantalum, or of alloys thereof, or of some other heat-resistant material.

Inside the jacket tube 1 is disposed a thin-walled internal heating or combustion tube 6, through which the hot gas 4 for heating is passed. This thin-walled combustion tube 6 is preferably made of a material having a very high melting point, for example nickel or nickel alloys. However, since this tube does not surround the actual system, a ceramic material may also be used.

The combustion tube 6 is supported by support means 5 on the inside wall of the jacket tube 1.

The support means 5 may be so shaped as to assist the transfer of heat.

Figure 13:
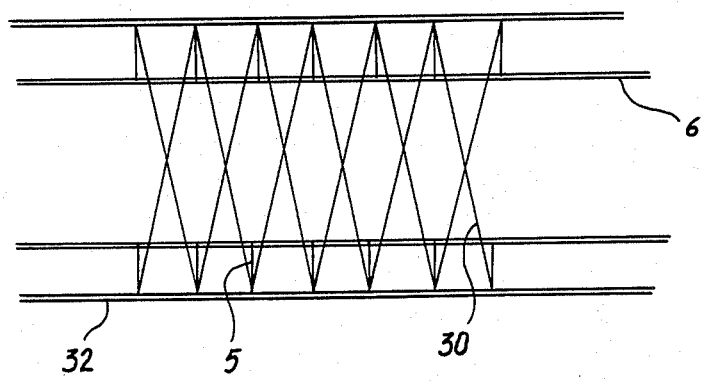
FIG. 13 is a partial axial cross-section of a modified tube in accordance with the invention.

Instead of being a closed tube, the external reinforcement 3 may also consist of a network of wires 30, shown in FIG. 13, cross-wise wound wires or longitudinally extending wires and wires wound along a helical line, these wires being if necessary supported by an additional jacket 32.

FIG. 4 shows the cross-section of the composite tube corresponding to FIG. 3. The support means 5 shown here are flat in side view and may for example consist of fins provided on the combustion tube 6. The support means 5 may also consist of a flat strip wound helically around the inner tube 6.

Figure 5:
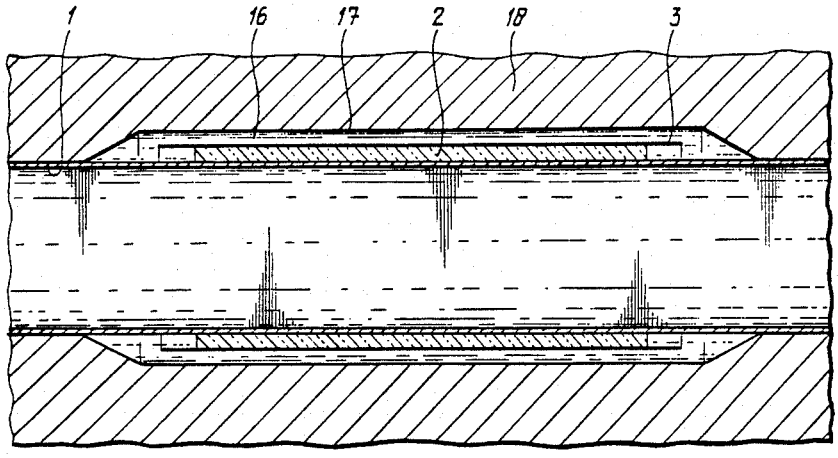
FIG. 5 shows a modified form of construction of the composite tube according to the invention, in axial section.

FIG. 5 shows that for the purpose of shielding the molybdenum, tungsten or tantalum sheath 3 an additional covering 17, which may for example be tubular, can be disposed over the whole arrangement, in such a manner that a vacuum can be produced in the space 16 under this covering.

The space between the outer sheath 3 and the intermediate jacket tube 1, and also that between the outer sheath 3 and the covering 17, may also with great advantage be filled with a thermal insulation material, whereby the whole arrangement is still further strengthened and a compact assembly is obtained, while temperatures are lowered still more quickly in the outward direction. Furthermore, the combination can be provided externally with additional thermal insulation 18.

Figure 6:
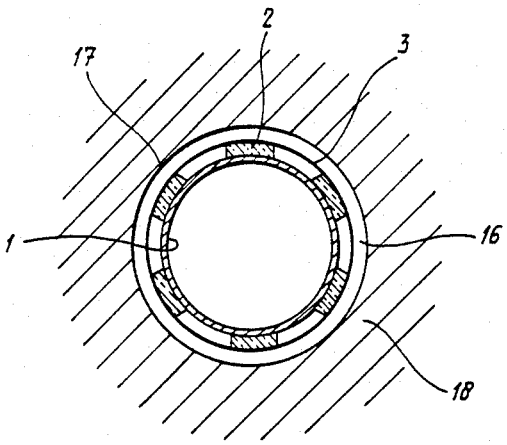
FIG. 6 is a radial cross-section of the tube shown in FIG. 5.

In FIGS. 5 and 6 the inner combustion tube 6 is omitted for the sake of clarity.

Figure 1:
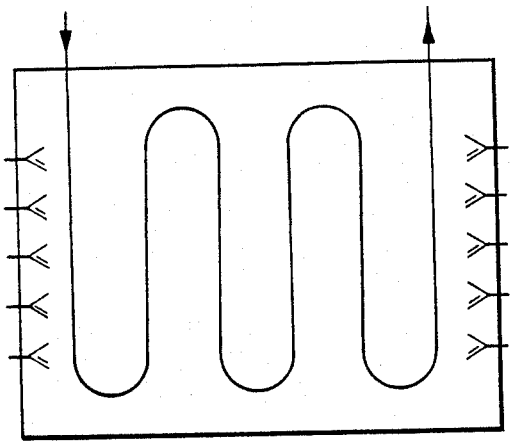
PRIOR ART fig-1
FIG. 1 is a schemtic representation of a conventional furnace.
Figure 2:
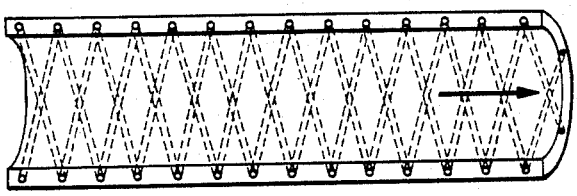
PRIOR ART fig-2
FIG. 2 shows, partly in section, a known composite tube reinforced with armouring wires.
Figure 7:
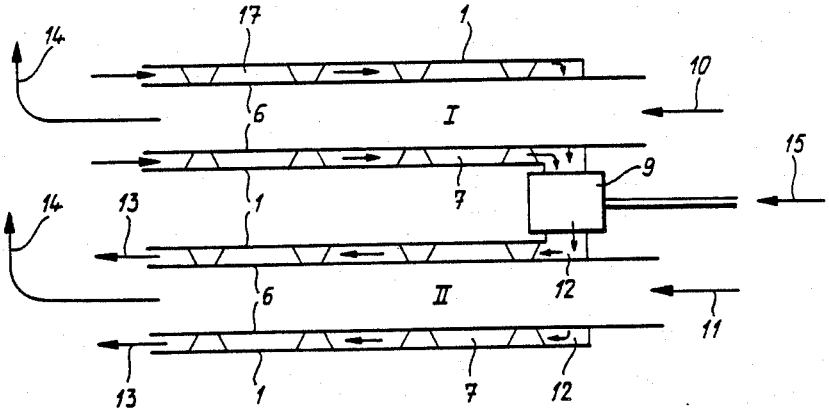
FIG. 7 shows an arrangement in which a number of composite tubes according to the invention are used in a cracking plant.

FIG. 7 shows the use of the composite tubes according to the invention in a cracking plant. A larger plant will as a rule be composed of a plurality of parallel units based on the principle illustrated here.

The heating or combustion gas 10 is passed through the inner tube 6 of the element I in order to heat the steam or gas in the space 7 between the jacket tube 1 and the tube 6. The gas in question is first preheated in conventional manner to, for example, 900° C. or even 1075° C. This gas is then further heated in the space 7 of the element I, for example to 1350° or 1400° C.

In the mixing chamber 9 the hot gas mixture or steam is mixed with hydrocarbons introduced at 15, and the cracking reaction starts, the mixture then being passed at 12 outside the mixing chamber 9 into the space between the jacket tube 1 and the inner tube 6 of the element II.

In this element II the additional reaction required is carried out and heat is supplied to the mixture 12 from the hot gas 11 in the tube 6 until the cracking product 13 is obtained. This cracking product 13 is then quickly cooled as it passes out.

The outgoing combustion gases 14 can be used for preheating the gas (steam) before the latter enters the space 7 in element I, and for heating the hydrocarbons at 15 before they enter the mixing chamber 9.

Figure 8:
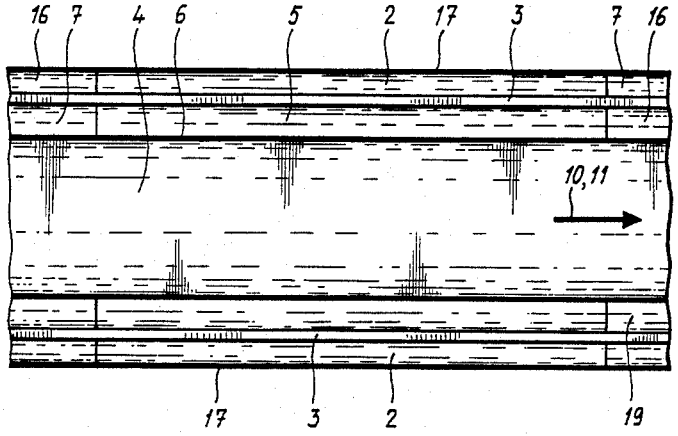
FIG. 8 is an axial section of a third form of construction of the composite tube according to the invention.
Figure 9:
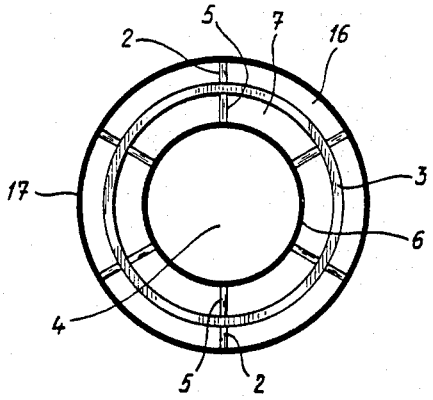
FIG. 9 is a radial cross-section of the composite tube shown in FIG. 8.

In cases where an inert gas is to be heated, the outer reinforcement 3 can, as illustrated in FIGS. 8 and 9, be applied direct around the combustion tube 6 containing the combustion gases. The combustion tube 6 is supported, for example with the aid of ceramic support means 5, on the outer sheath 3, which once again may be made of molybdenum, tungsten or tantalum, or of an element reinforced therewith, or of another highly heat-resistant material.

The enclosing tube 17 is then supported on the outer reinforcement 3 with the aid of ceramic spacers 2.

The hot combustion gas 10, 11 for heating the inert gas at 19 is passed through the interior of the combustion tube 6.

The inert gas at 19, which is now situated between the inner tube 6 and the reinforcement 3, is passed, in the same direction as the combustion gas or in the opposite direction, through the space 7 between the tubes 6 and 3.

The space 16 between the tubes 3 and 17 can be filled with an inert gas or be evacuated in order to protect the tube 3 against corrosion or oxidation.

The space 8 may also be filled with an insulating material, thus forming a more compact and stronger unit and further reducing loss of heat, while the temperature of the wall 17 is further lowered.

The pressure in the space 8 is preferably kept lower than in the spaces 7 and 4 in the tube 6.

The heating gases may also be formed in a combustion chamber and then passed to a large number of combustion or heating tubes 6, while it is also possible to provide all the heating tubes 6 with an individual burner, thus achieving a high degree of controllability.

Figure 10:
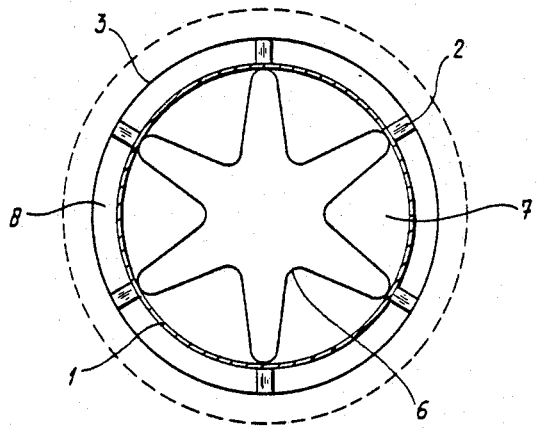
FIGS. 10 and 11 show modified forms of construction of the internal combustion tube.

In addition, it is not necessary for the elements to consist of circular tubes. As shown in FIG. 10, the inner combustion tube 6 for example may, inter alia, be given a different profile, whereby in certain cases the transfer of heat and the performance of the process are favourably influenced.

Figure 11:
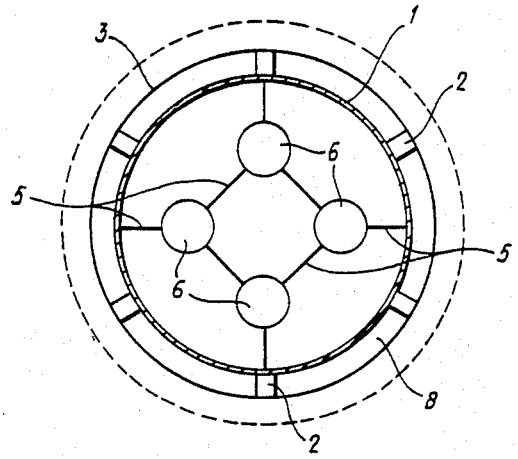

A plurality of tubular or profiled combustion or heating tubes 6 may moreover be disposed inside the intermediate jacket tube 1 (if required) or directly inside the reinforcement 3. A larger heated surface is thus for example obtained-see FIG. 11. As in previous cases, the tubes 6 are carried by support means 5, while the jacket tube 1 is supported by spacer means 2 on the outer reinforcement 3.

In cases where a very considerably thickness of insulation can be accommodated inside the highly heat-resistant outer reinforcement or cylinder 3, more conventional heat-resistant sheathing materials can be used, provided that the temperature there does not become too high.

Figure 12:
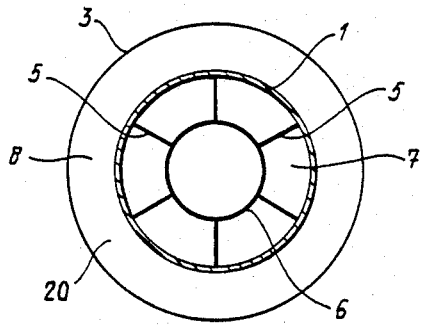
FIG. 12 is a cross-section of a combustion tube according to FIGS. 1 and 2, with modified spacer means.

Finally, FIG. 12 shows once again a special embodiment of the invention. The heating or combustion tube 6, supported by the support means 5, is situated, as in previous embodiments of the invention, in a cylindrical jacket tube 1. Between the outer reinforcement 3 and the jacket tube 1 insulating material 20 of considerable thickness is disposed as spacing or support means. The outer reinforcement 3 will thus reach a temperature level enabling this wall to be made of a heat-resistant material, such as heat-resisting steel, not requiring inert shielding or a vacuum.

In certain cases the insulating action of the insulation 2 can also be obtained by installing radiation shields in the space between the jacket tube 1 and the outer reinforcement 3 or the insulation 2.

It is obvious that the invention is not limited to the embodiments illustrated in th drawings and discussed above, but that modifications and additions are possible without going beyond the scope of the invention. Thus, for example, it is possible to dispose on the interposed jacket tube 1 a ceramic material on which reinforcement wires 3 are wound, which in turn cam be embedded in ceramic material.

What is claimed is:

1. Composite tube adapted for heating gases to temperatures in excess of about 1300° C., comprising:

(a) an internal combustion or heating tube which is adapted to carry internally, heating gases at a temperature in excess of about 1300° C., which tube is resistant to the milieus of the gases, and has high heat transfer properties;

(b) an external reinforcement of high strength which completely surrounds said internal tube, and which consists essentially of molybdenum, tungsten, tantalum, niobium or a mixture thereof;

(c) spacer means separating said internal tube from said external reinforcement;

(d) a passageway for gases to be heated located between said external reinforcement and said internal combustion and heating tube such that gases to be heated contact the internal combustion or heating tube externally;

(e) means for supplying gases to be heated to said passageway; and (f) means for supplying heating gases at a temperature in excess of about 1300° C. internally of said internal combustion or heating tube.

2. Composite tube according to claim 1, wherein at least one spacer means is (2,5) is made of ceramic material.

3. Composite tube according to claim 1, wherein the external reinforcement (3) comprises a network of wires, wires wound crosswise, or longitudinally extending wires and wires wound on a helical line.

4. Composite tube according to claim 1, wherein the internal combustion or heating tube (6) has a wall thickness between about 0.5 and 1 mm.

5. Composite tube according to claim 1, wherein the tubes have profiles different from a cylindrical shape.

6. Composite tube according to claim 1, wherein inside the external reinforcement (3) and/or inside the jacket tube (1) there is disposed a plurality of parallel combustion or heating tubes (6) which are supported with the aid of support means (2,5).

7. Composite tube according to claim 1, wherein the space between the jacket tube (1) and the external reinforcement (3) is filled with thermal insulating material.

8. Composite tube according to claim 1, wherein the support means (5) consist of radially directed plates extending between the jacket tube (1) or the external reinforcement (3) and the internal tube (6).

9. Composite tube according to claim 1, wherein the support means (5) comprises an upright strip wound helically around the internal tube (6).

10. Composite tube according to claim 1, wherein the spacer means (2) comprises flat plates of ceramic material having a thickness equal to the spacing desired between the external reinforcement (3) and the interposed jacket tube (1).

11. Composite tube according to claim 1, additionally comprising a further covering means (17) disposed around the external reinforcement (3).

12. Composite tube according to claim 1, wherein said internal combustion or heating tube consists essentially of Ni or a Ni alloy having a thickness of about 0.5 to 1 mm.

13. Composite tube according to claim 1, wherein a further covering (17) is disposed around the external reinforcement (3) and that the space (16) between this covering (17) and the reinforcement (3) is filled with an inert gas or is evacuated.

14. Composite tube according to claim 13, wherein thermal insulating material is disposed outside the additional covering (17).

15. Composite tube according to claim 1, wherein the internal combustion or heating tube (6) is made of material having a high melting point.

16. Composite tube according to claim 15, wherein the internal tube (6) is made of nickel or alloys of nickel.

17. Composite tube according to claim 15, wherein the internal tube (6) consists essentially of ceramic material.

18. Composite tube according to claim 1, wherein between the internal combustion or heating tube (6) and the external reinformcement (3) a jacket tube (1) is disposed which with the aid of spacer means (2,5) is held apart from the internal tube (6) and the external reinforcement (3) respectively.

19. Composite tube according to claim 18, wherein the interposed jacket tube (1) is made of ceramic material.

20. Composite tube according to claim 18, wherein the spacer means (2,5) is made of ceramic material.

* * * * *